US006578632B2

(12) United States Patent
Mullins

(10) Patent No.: US 6,578,632 B2
(45) Date of Patent: Jun. 17, 2003

(54) SWING MOUNTED FILL-UP AND CIRCULATING TOOL

(76) Inventor: Albert August Mullins, 18706 Acaro Glen Ct., Humble, TX (US) 77346

( * ) Notice: Subject to any disclaimer, the term of this patent is extended or adjusted under 35 U.S.C. 154(b) by 0 days.

(21) Appl. No.: 09/929,951

(22) Filed: Aug. 15, 2001

(65) Prior Publication Data

US 2003/0034157 A1 Feb. 20, 2003

(51) Int. Cl.[7] ..... E21B 19/16
(52) U.S. Cl. ..... 166/90.1; 166/177.4
(58) Field of Search ..... 166/77.4, 90.1, 166/177.4, 75.13

(56) References Cited

U.S. PATENT DOCUMENTS 5,918,673 A * 7/1999 Hawkins et al. ..... 166/285
6,390,190 B2 * 5/2002 Mullins ..... 166/90.1
6,415,862 B1 * 7/2002 Mullins ..... 166/90.1

* cited by examiner

*Primary Examiner*—William Neuder
(74) *Attorney, Agent, or Firm*—Duane Morris LLP

(57) ABSTRACT

A mounting system for a fill-up and circulating tool on the rig hoisting system is disclosed. In the preferred embodiment, the tool is supported on one of the bails and it driven to rotate around the longitudinal axis of one of the bails. A combined vertical and rotational movement is imparted by the mounting system to allow the fill-up and circulating tool to be raised and swung out from between the bails to allow normal drilling or tripping. In the other position it can be swung over the tubular and lowered for sealing contact to allow fluids to pass in both directions to or from a pumping and storage system on the rig.

20 Claims, 12 Drawing Sheets

SWING MOUNTED FILL-UP AND CIRCULATING TOOL

FIELD OF THE INVENTION

The field of this invention relates to fill-up and circulating tools which are mounted to a drilling rig hoisting system and more particularly to one of its bails to allow the fill-up and circulating tool to be moved aside rather than dismantled when operations such as drilling or tripping pipe are taking place.

BACKGROUND OF THE INVENTION

During the process of drilling and completing a well it is necessary to run or pull the pipe into or out of the wellbore, in a processes commonly called "tripping", where it is necessary to connect and disconnect the uppermost adjacent pieces of tubular many times. These adjacent pieces can consist of one or more individual pieces or joints of the complete tubular string. Because of problems associated with the drilling of a well it is often necessary to capture fluid from the upper end of the tubular or circulate fluid through the tubular while tripping. To capture or circulate fluid it is necessary to connect a device commonly known as a fill up and circulating tool to the upper end of the uppermost tubular. When using a top drive rig it is common to connect the top drive directly to the upper tubular by threading the top drive into the tubular. Recently it has become common to use the device illustrated in PCT/US99/22051 when attached to the top drive.

In some cases and when using a conventional "rotary rig" devices such as those illustrated in U.S. Pat. Nos. 4,997,042; 5,191,939; 5,735,348 and others are used. These devices have substantial limitations in that they cannot be used with all tubulars commonly used in the drilling and completion of a well and they cannot easily be placed in an "out of the way" position and must be removed when it is necessary to drill.

In a related earlier U.S. application Ser. No. 09/638,809, which is fully incorporated herein as though actually set forth, several fill up and circulating devices are illustrated which require a handling device to assist in positioning them in sealing and coupling contact with the tubular connection and to allow sealing and coupling to the upper end of the uppermost tubular. In this application several methods for handling these devices were disclosed. One such technique for accommodating the need to get the equipment out of the way to facilitate drilling was to put the fill-up and circulating tool on swing mounts from both opposed bails and to somehow swing the fill-up and circulating tool out from between the bails to get it out of the way from the tubing in the elevator. This design involved a need for considerable clearance space to make a large arc for the swing motion and a fairly unwieldy method of hoisting and lowering the fill-up and circulating tool throughout its arcuate range of motion. Additionally, the fill-up and circulating tool had to be held in the out of the way position by cable and presented a risk of falling back down toward the tubular if the support cable failed for any reason.

Current fill-up and circulating devices illustrated in the 042', 939'and 348'patents are connected to the tubular connection of the top drive or attached to the hook of a conventional hoisting system of a rotary rig. In order to drill these devices must be removed so that the tubular can be connected to the top drive or the tubular is connected to a kelly which is connected to the hook of a rotary rig.

Therefore, in addition to handling the fill up and circulating devices to position them at the tubular for coupling and sealing to the tubular, it is also desirable to have the handling device move the fill up and circulating device to an "out of the way" position when not sealed or coupled to the tubular. "Out of the way" meaning that the position of the handling device and any device attached to it or not in the way or inhibit the processes of rig operation and specifically the handling or tripping of the tubulars or the drilling process.

Accordingly, it is an object of the present invention to provide an apparatus for handling the devices for filling and circulating a tubular, to place the apparatus for filling and circulating the tubular in sealing and coupled contact with the tubular and to move the apparatus for filling and circulating the tubular and the handling device "out of the way".

Another object of the invention is to provide a means for connecting the fill up and circulating device to a pump or other fluid supply or storage system.

Another objective of the invention is to provide a method of installation and operation that does not require the device to be removed from the hoisting device to conduct any rig operation. Another objective is to have a handling system that is simple to operate, and which does not require significant space for its movements, and which will reliably position the fill-up and circulating tool over the tubular for rapid makeup or release.

SUMMARY OF THE INVENTION

A mounting system for a fill-up and circulating tool on the rig hoisting system is disclosed. In the preferred embodiment, the tool is supported on one of the bails and it is driven to rotate around the longitudinal axis of one of the bails. A combined vertical and rotational movement is imparted by the mounting system to allow the fill-up and circulating tool to be raised and swung out from between the bails to allow normal drilling or tripping. In the other position it can be swung over the tubular and lowered for sealing contact to allow fluids to pass in both directions to or from a pumping and storage system on the rig.

DETAILED DESCRIPTION OF THE PREFERRED EMBODIMENT

Figure 1:
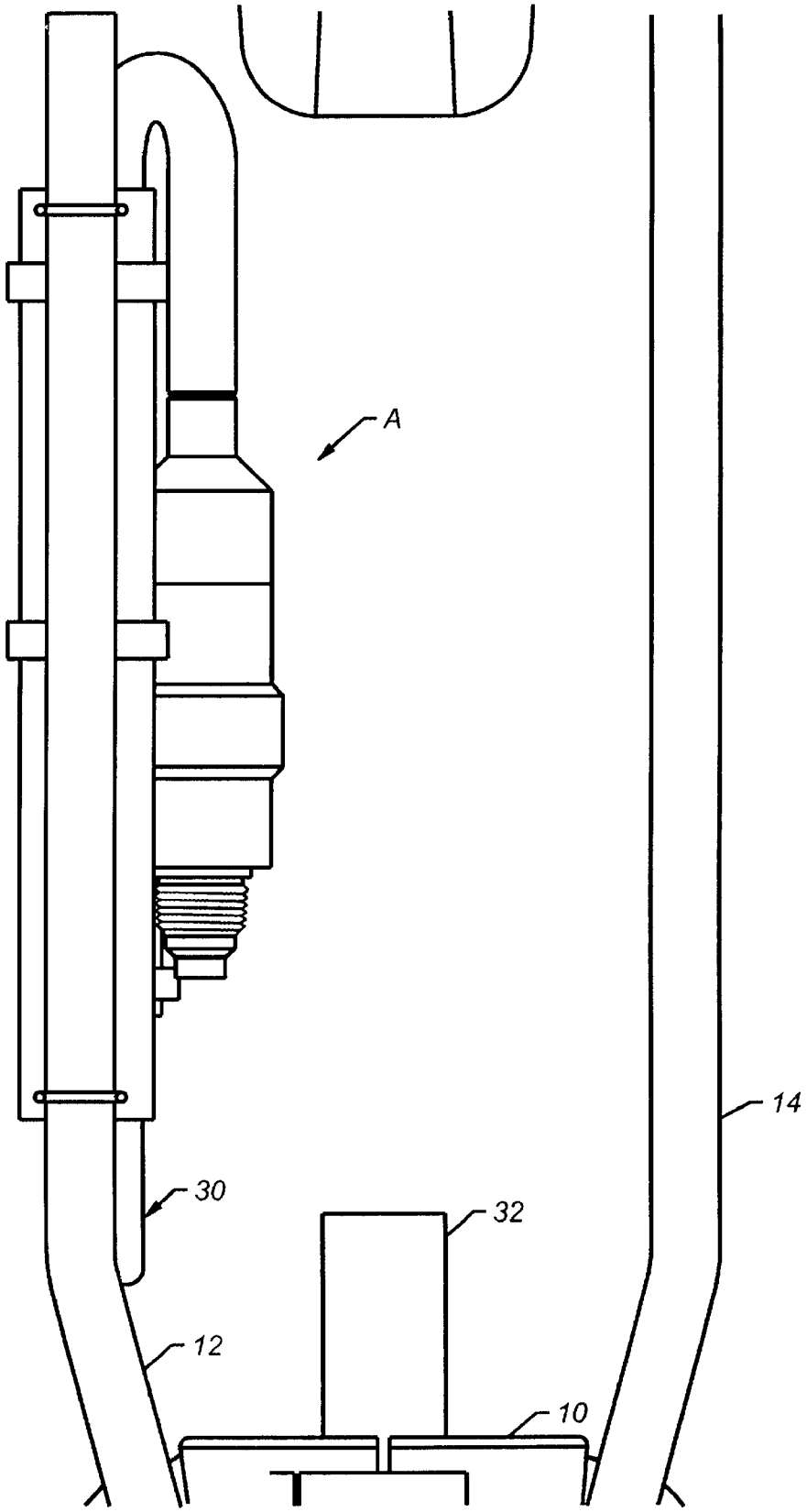
FIG. 1 is a front view showing both bails with the fill-up and circulating tool in the out of the way position.
Figure 3:
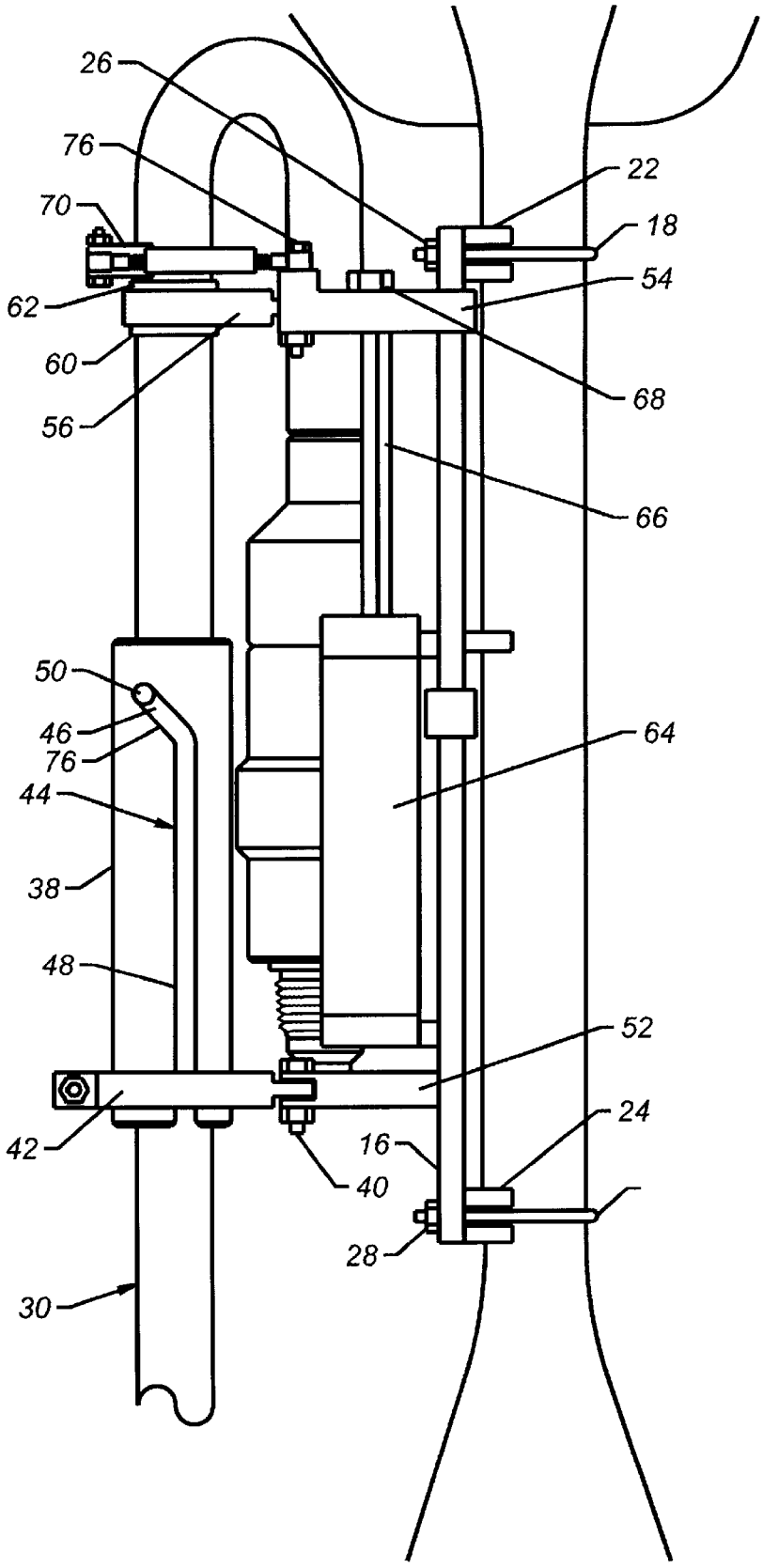
FIG. 3 is a side view of the view of FIG. 1.

Referring to FIG. 1 the open side of the elevator 10 is shown supported from bails 12 and 14. The apparatus A is connected to bail 12 but could as easily be supported from the other bail 14. As best seen in FIG. 3 a frame 16 is secured to bail 12 by U-bolts 18 and 20 which extend, respectively, through clasps 22 and 24 and are secured, respectively by nuts 26 and 28. Clasps 22 and 24 are generally U-shaped and can have internal serrations where they contact the bail 12 for additional resistance to rotation of the frame 16 with respect to bail 12. Other techniques to rotationally lock the frame 16 to the bail 12 can also be employed, such as a splined connection or additional support for frame 16 from the other bail 14. On new construction, as opposed to a retrofit, the frame 16 can be made integrally with one of the bails, such as 12.

Figure 2:
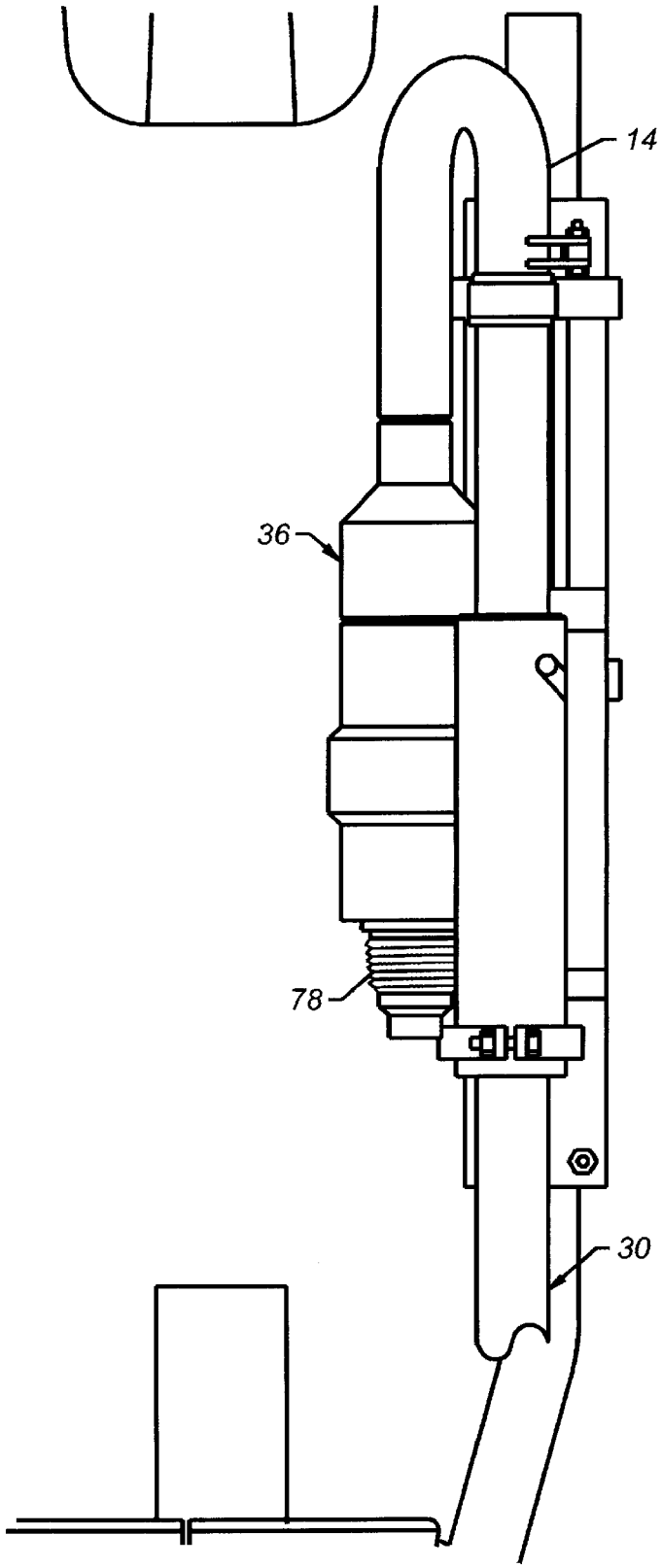
FIG. 2 is the back view of the view of FIG. 1.

Referring to FIG. 2, an inlet pipe 30 is connected to the rig pumping and storage system to allow for flow to and from the apparatus A when sealingly connected to a tubular 32.

Figure 4:
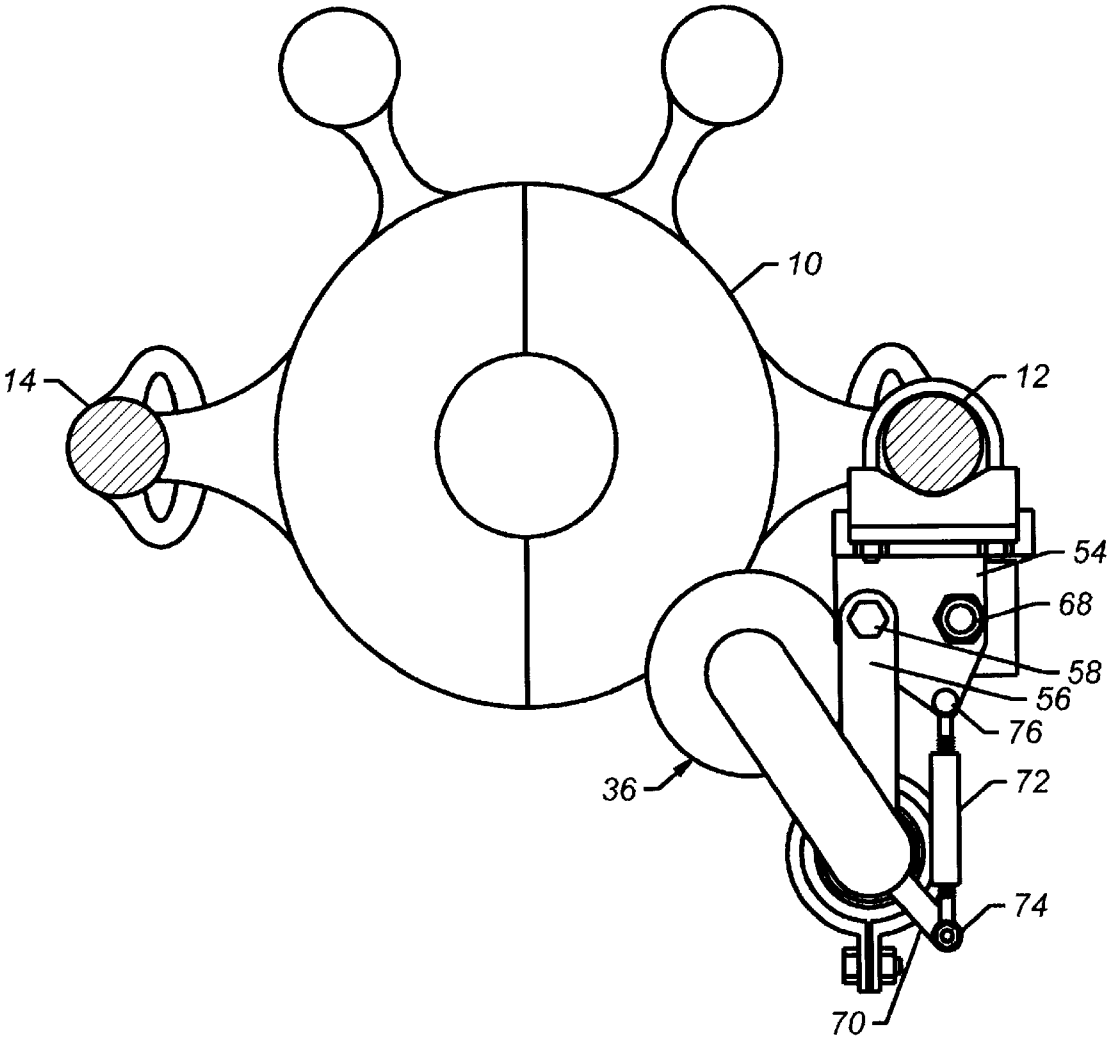
FIG. 4 is a top view of the view of FIG. 1.

Referring to FIG. 3, inlet pipe 30 has a U-bend 34, which is in turn connected to the top of the fill-up and circulating tool 36. Inlet pipe 30 extends through sleeve 38. Sleeve 38 is clamped for pivotal movement about pin 40 by a clamp 42.Pin 40 extends into bracket 52, which is supported by frame 16. Sleeve 38 has an elongated slot 44, the upper portion 46 being inclined with respect to longitudinal portion 48, which is oriented generally parallel to bail 12. Inlet pipe 30 has a pin 50 which rides in slot 44. Bracket 54 is supported by frame 16 for up and down slidable movement. Link 56 is pivotally mounted at pin 58 as best seen in FIG. 4, to bracket 54. Link 56 surrounds inlet pipe 30 in a manner that permits relative rotation between them. Link 56 is mounted between flanges 60 and 62 on inlet pipe 30. Up and down movement of bracket 54 is preferably accomplished by hydraulic cylinder 64 which can selectively be used to extend or retract rod 66. Rod 66 is secured to bracket 54 by nut 68. Hydraulic cylinder 64 can be replaced by any other device which will raise and lower bracket 54.

Connected to inlet pipe 30 is a yoke 70 to which is connected link 72 at pin 74. Pin 76 connects the other end of link 72 to bracket 54.

Figure 5:
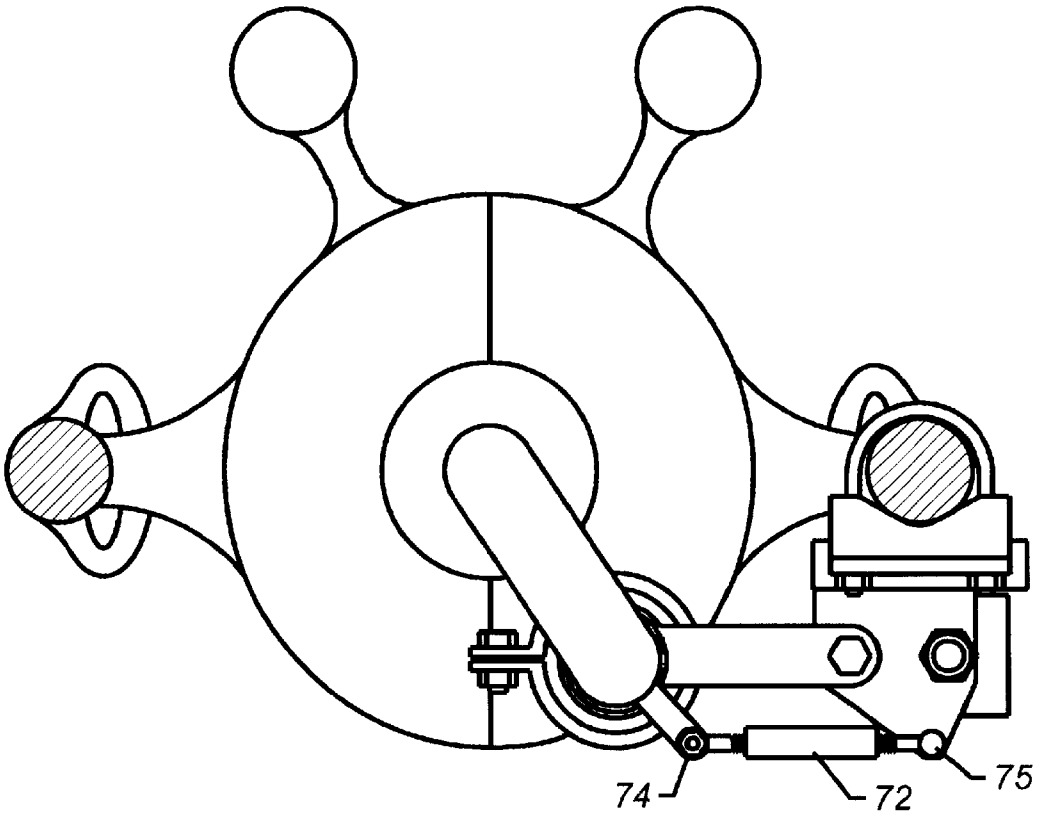
FIG. 5 is a top view showing the fill-up and circulating tool in the centered position over the elevator for connection to a tubular.
Figure 6:
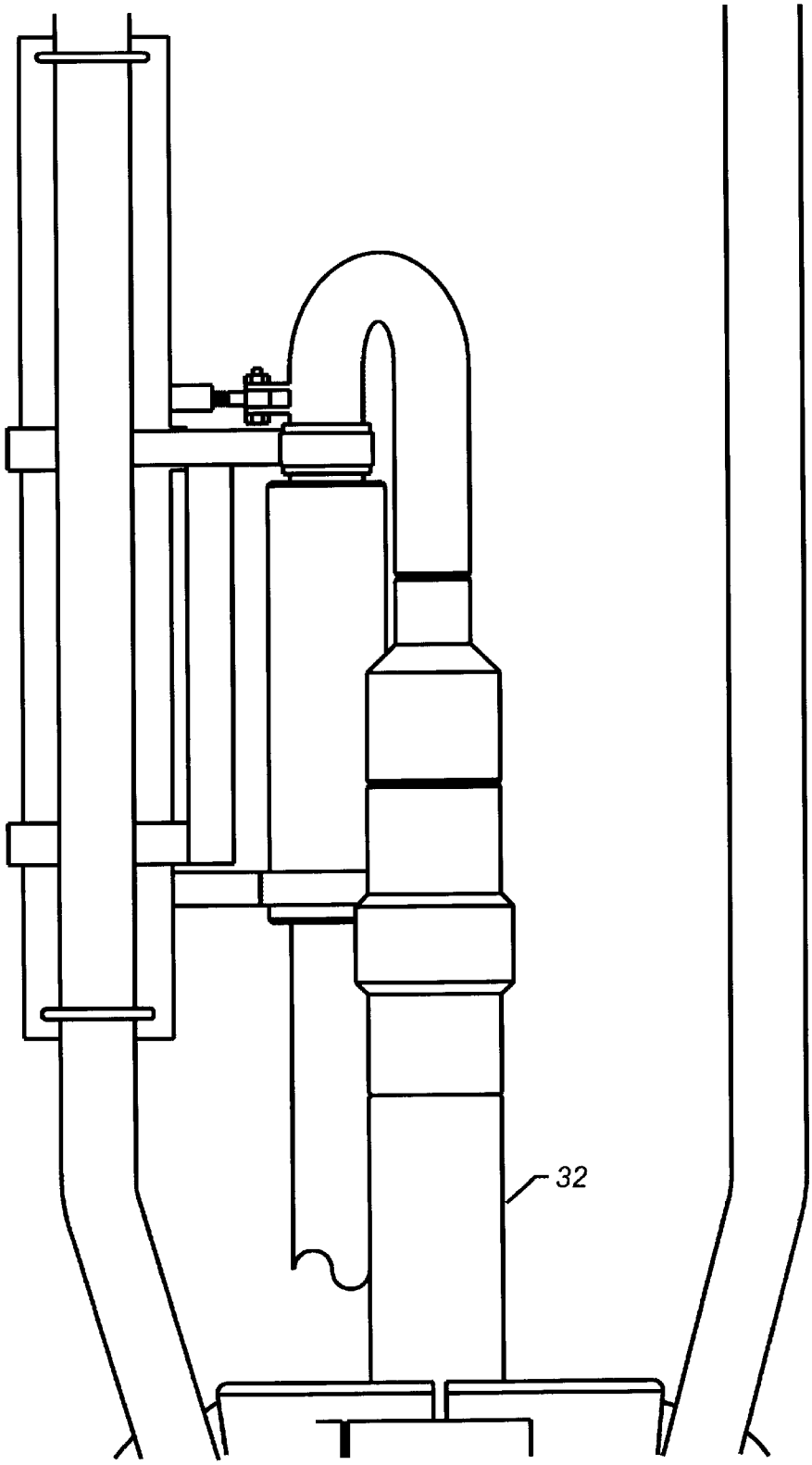
FIG. 6 is a front view of FIG. 5.

The components now having been described, the operation of the device will now be reviewed. The intended movement of the fill-up and circulating tool 36 is intended to be from a retracted position, shown in FIG. 4 to a connected position shown in FIG. 5. Clamp 42 allows rotation of sleeve 38 as installed and link 72 has an adjustable length to define the proper length, as installed, for smooth movement of the assembly and final positioning of the fill-up and circulating tool 36 in alignment with the tubular 32. Referring to FIG. 3, the fill-up and circulating tool is in the out of the way position with rod 66 fully extended and pin 50 in the upper end 46 of slot 44. When the hydraulic cylinder 64 is actuated to move rod 66 downwardly the inlet pipe 30 moves down. The pin 50 is forced against the inclined surface 76 of the upper end 46 of slot 44. This contact induces opposed rotational motion between the inlet pipe 30 and the sleeve 38 as long as pin 50 exerts downward pressure on inclined surface 76. Sleeve 38 rotates about pin 40, while at the same time link 56 rotates about pin 58. As a result, the movement of the fill-up and circulating tool is along a near straight line into the position in FIG. 5. The inlet pipe rotates counter clockwise looking down, as seen by comparing FIG. 4 to FIG. 5. Links 42 and 56 rotate clock-wise looking down in the same Figures. The rotational movement ceases when the pin 50 enters the lower end 48 of the slot 44. This position, corresponds to an alignment of the fill-up and circulating tool with the tubular 32. Link 72 is a torque link that resists the torque created by the pin 50 moving on inclined surface 76 and, in turn creates the rotation of links 42 and 56 respectively about pins 40 and 58.

The design of the fill-up and circulating tool 36 is independent of the apparatus A, such that any kind of tool can be used and moved into position or out of the way as desired. The connection 78 is intended to be schematic, although it looks like a thread. The fill-up and circulating tool can seal using a cup seal or through engagement with the threads of the tubular in various embodiments described below or in other ways illustrated by other known designs.

Figure 7:
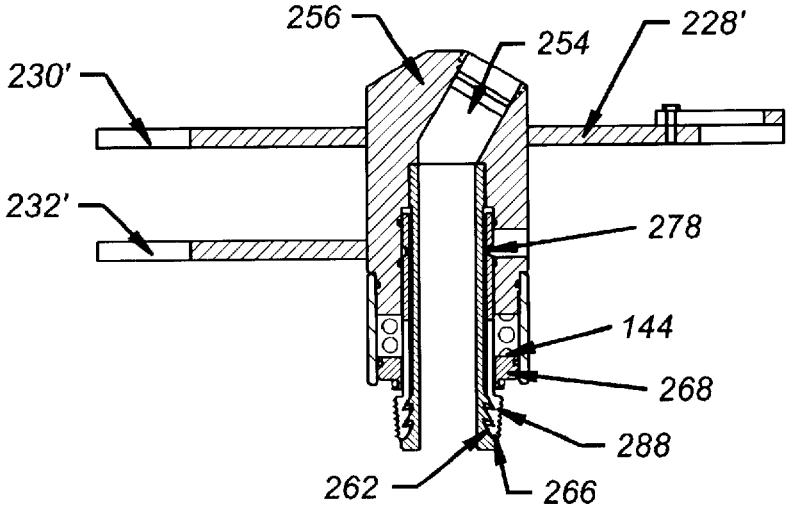
FIG. 7 is a detailed view of an alternative technique for engaging a tubular with the apparatus where rotation is not required.
Figure 8:
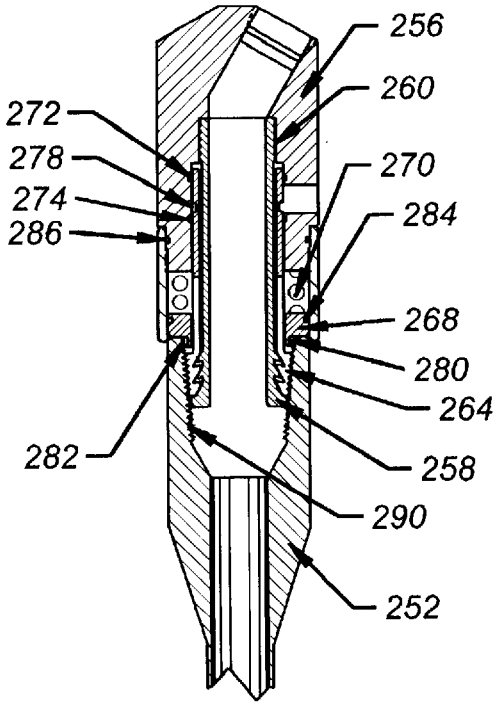
FIG. 8 is a detailed view showing how the engagement and sealing portion operates without rotation.

Referring now to FIGS. 7 and 8, the embodiment which allows the connection to be made up by simply pushing in the apparatus A into a tubular 252 is disclosed. As before, a frame 228' has aligned openings 230' and 232' to engage the bails (not shown). A mud hose (not shown) is connected to connection 254 and may include a valve (not shown). The mud hose (not shown) is connected into a housing 256. Secured within housing 256 is locking member 258, which is held to the housing 256 at thread 260. A series of downwardly oriented parallel grooves 262 are present on the locking member 258. A locking collet 264 has a series of projections 266 which are engageable in grooves 262. A piston 268 is biased by a spring 270 off of housing 256 to push down the collet 264. Since the locking member 258 is fixed, pushing down the collet 264 ramps it radially outwardly along the grooves 262 of locking member 258 for engagement with a tubular 252, as shown in the final position in FIG. 8. Seals 272 and 274 seal around opening 276. A groove 278 is accessible through opening 276 for release of the apparatus A by insertion of a tool into groove 278 and applying a force to drive the collet 264 upwardly with respect to locking member 258, thus moving projections 266 withing grooves 262 and allowing the apparatus A to be retracted from the tubular 252. A seal 280 lands against surface 282 in the tubular 252 for sealing therewith, as shown in FIG. 8. Another seal 284 is on piston 268 to prevent loss of drilling mud under pressure which surrounds the spring 270 from escaping onto the rig floor. Similarly, seal 286 serves the same purpose.

Those skilled in the art will appreciate that in this embodiment, the apparatus A is simply brought down, either with the help of a rig hand lowering the traveling block or by automatic actuation, such that the collet 264, which has an external thread 288, can engage the thread 290 in the tubular 252. This occurs because as the apparatus A is brought toward the tubular 252, the piston 268 is pushed back against spring 270, which allows the collet 264 to have its projections 266 ride back in grooves 262 of the locking mechanism 258. The spring 270 continually urges the seal 280 into sealing contact with the mating tubular surface. Upon application of a pickup force to the housing 256, the locking mechanism 258 along with its grooves 262 cam outwardly the projections 266 on the collet 264, forcing the thread 288 into the thread 290 to secure the connection. At that time, the seal 280 is in contact with the internal surface 282 of the tubular 252 to seal the connection externally. Those skilled in the art will appreciate that internal pressure in bore 292 will simply urge the locking member 258 in housing 256 away form the tubular 252, which will further increase the locking force on the collets 264, and that the internal pressure will also urge piston 268 into contact with the tubular member 252, maintaining sealing engagement of seal 280. As a safety feature of this apparatus, in order to release this connection, the pressure internally in bore 292 needs to be relieved and a tool inserted into slot 278 so that the collets 264 can be knocked upwardly, this pulling them radially away to release from the thread 290 on tubular 252. Sequential operations of a valve on the mudline (not shown) can be then employed for spill-free operations on the rig floor. Essentially, once the connection s made as shown in FIG. 8, the valve on the mudline is opened and the tubular 252 can be run into or out of the hole. The connection is then released as previously described by use of groove 278. As in the other embodiments, the full bore is maintained.

Figure 9:
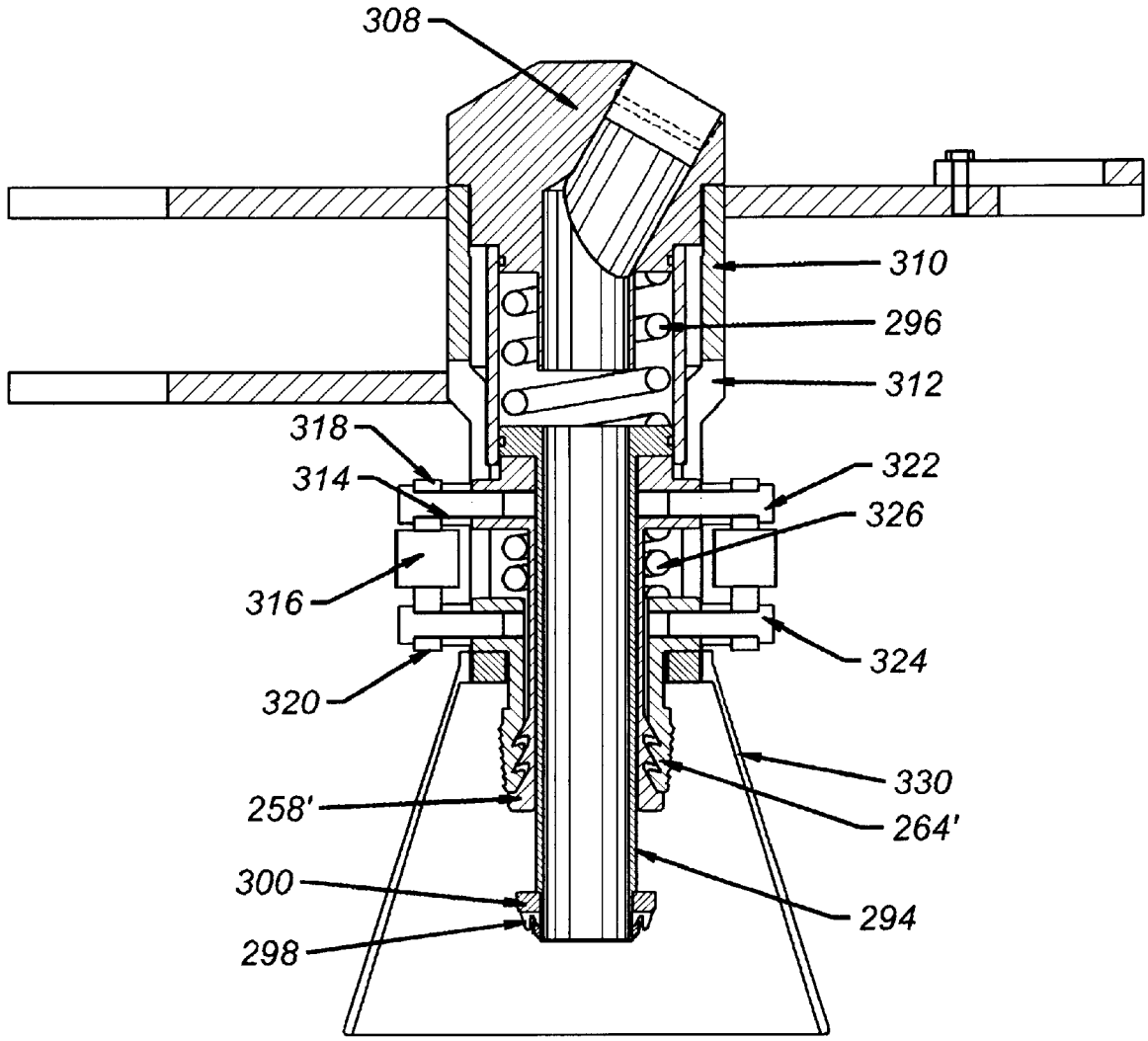
FIG. 9 is an alternate assembly of a more automated alternative to that shown in FIG. 8, showing not only the thread engagement and releaseable portion but also the sealing tube feature of the apparatus.
Figure 10:
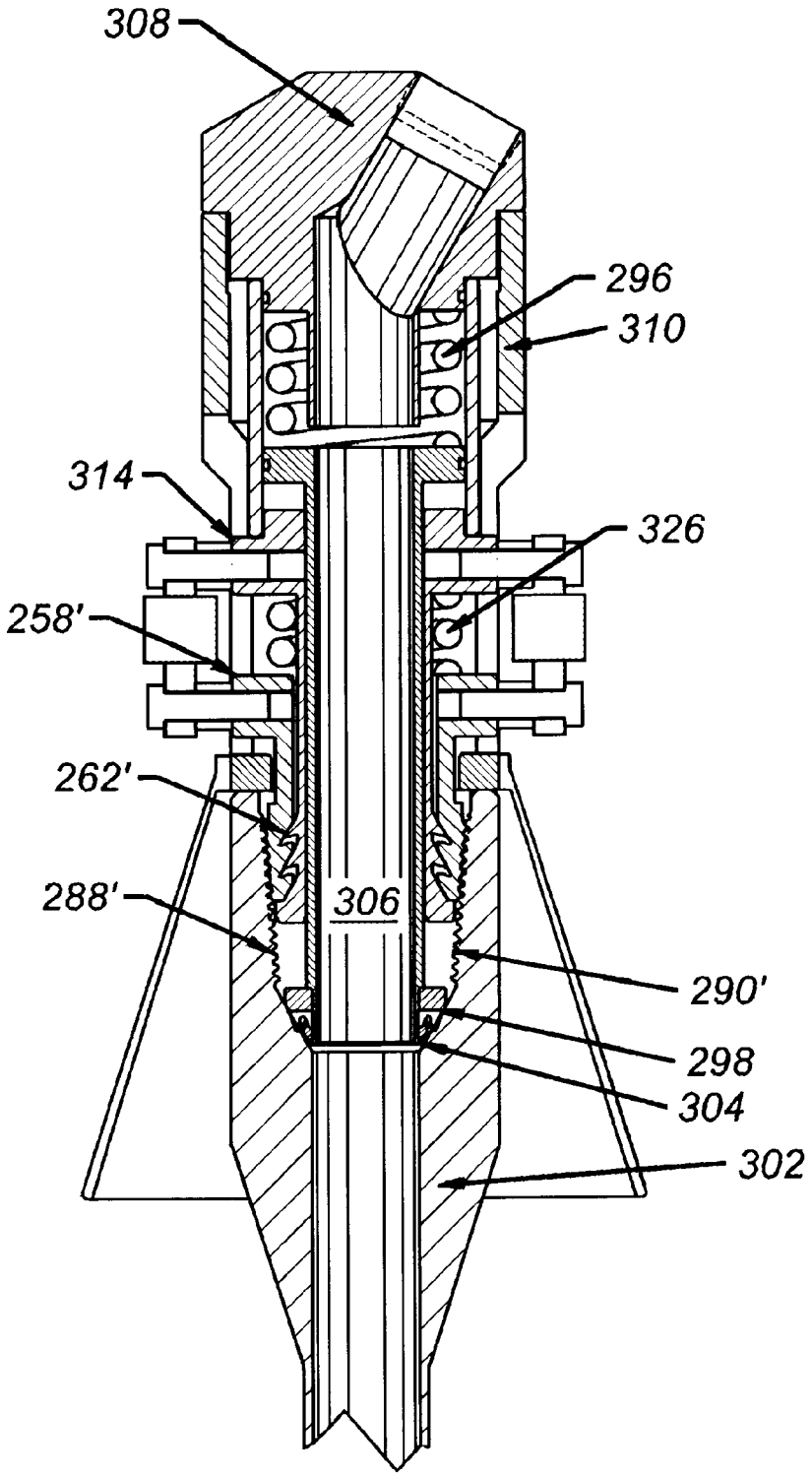
FIG. 10 is a complete apparatus incorporating the details of FIG. 9, showing engagement into a tubular.

There may be difficulty in getting the connection shown for the apparatus A in FIGS. 7 and 8 to release through the use of a tool applied on groove 278. Accordingly, the next embodiment illustrated in FIGS. 9–14 can be employed to more fully automate the procedure. The principle of operation is similar, although there are several new features added. Where the operation is identical to that in FIGS. 7 and 8, it will not be repeated here. What is different in the embodiment of FIG. 9 is that there is a tube 294 which is now biased by a spring 296. At the lower end of tube 294 is a seal 298 which is preferably a chevron shape in cross-section, as shown in FIG. 9. An external shoulder 300 is used as a travel stop within the tubular 302 for proper positioning of the seal 298, as shown in FIG. 10. Thus, in this embodiment, the seal 298 engages surface 304 inside the tubular 302 for sealing therewith. Pressure in bore 306, in conjunction with the force from spring 296, keeps the tube 294 pushed down against the tubular 302. The other feature of this embodiment is that the locking and release is done automatically. Extending from the housing 308 is a frame 310 with a pair of opposed openings 312. Connected to locking 258' is a plate 314. A motor 316 which can be of any type has shafts 318 and 320 extending from it which can be selectively extended or retracted. The shafts 318 and 320 are respectively connected to connections 322 and 324. Connection 324 extends out of or is a part of the collets 264'. A spring 326 forces apart plate 314 from the assembly which is collets 264'.

Figure 11:
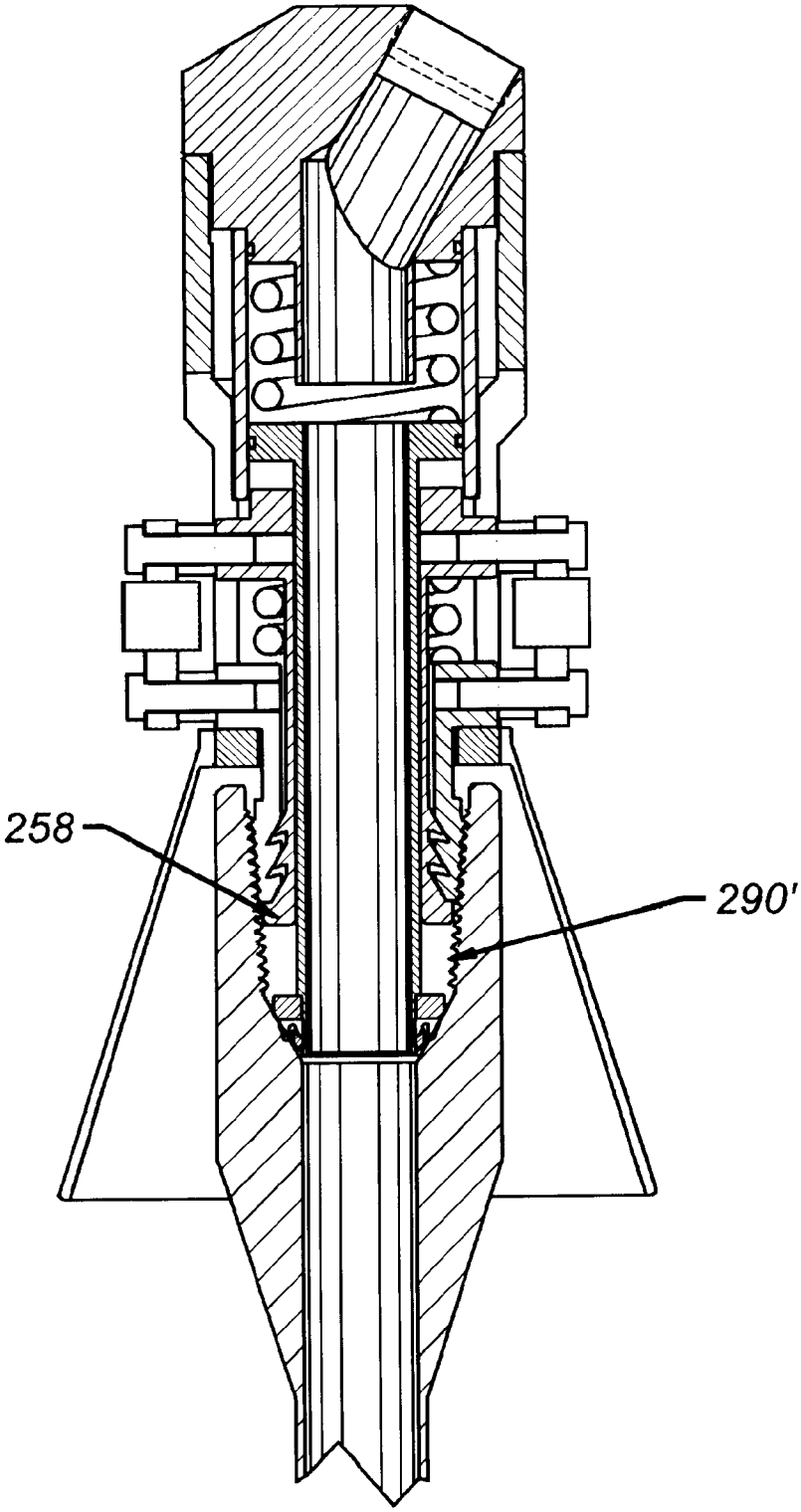
FIG. 11 shows the locked position of the apparatus shown in FIG. 9, with pressure applied internally.
Figure 12:
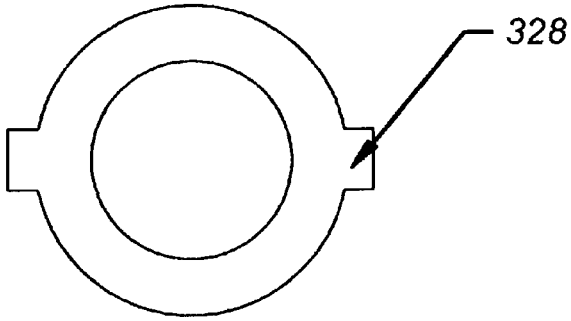
FIG. 12 is a detail of a component of the locking mechanism showing how it is guided by the apparatus.
Figure 13:
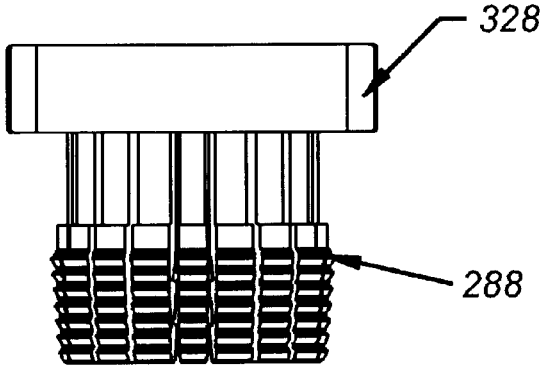
FIG. 13 is an elevational view of part of the locking mechanism for the apparatus.
Figure 14:
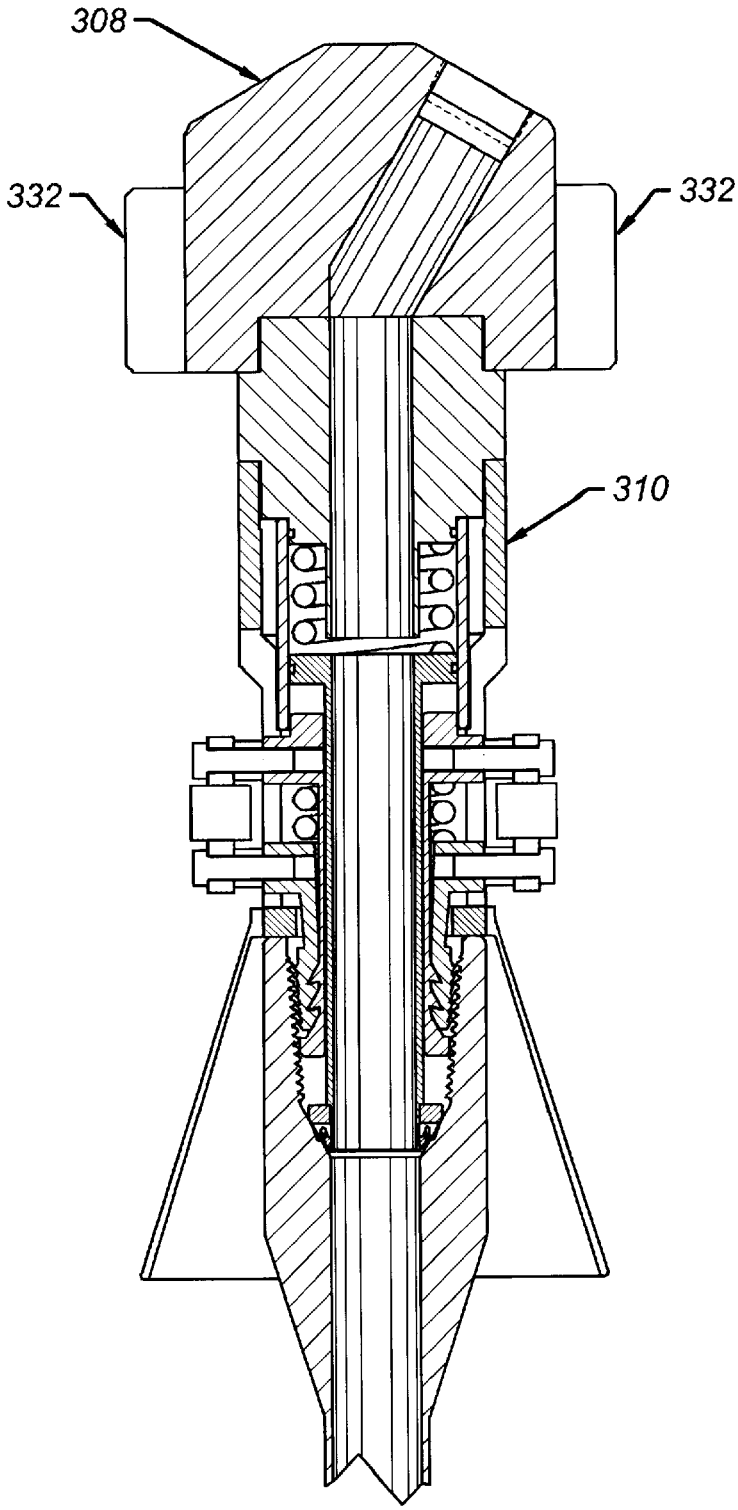
FIG. 14 is a view of the apparatus shown in FIG. 10 in the condition where it is released from the tubular below.

Those skilled in the art will appreciate that when it comes time to engage the apparatus A as shown in FIG. 9 into a tubular 302, the motor or motors 316 can be engaged to bring the plate 314 closed to the collet member 264' to thus retract the collet member 264' into the grooves 262' of the locking member 258'. This position is shown in FIG. 10, where the spring 326 is stretched as plate 314 is moved away from the collet assembly 264'. The collets with the thread 288' can now slip in and engage the thread 290 on the tubular 302. As this is happening, the spring 296 biases the tube 294 to engage the seal 298 onto surface 304. Thereafter, the motor or motors 316 are engaged to bring together the plate 314 from the collets 264', thus forcing the collets 264' to be cammed radially outwardly as the locking member 258 is forced upwardly by the motor or motors 316. The apparatus A is now fully connected, as shown in FIG. 11. The collet assembly 264' has a set of opposed dogs 328 shown in FIG. 12. These dogs 328 extend into openings or slots 312 to prevent relative rotation of the collet assembly 264' with respect to frame 310. A guide 330 is conical in shape and assists in the initial alignment over a tubular 302. The guide 330 is part of the frame 310 and the frame 310 lands on top of the tubular 302, as shown in FIG. 10. A more detailed view of the collet assembly 264', showing threads or grooves 288' which engage the thread 290 in the tubular 302, is shown in FIG. 13. FIG. 14 is similar to FIGS. 9–11, with the exception that the housing 308 is more readily removable from the frame 310 using lugs 332 which can be hammered onto make or release the joint between the housing 308 and the frame 310. In all other ways, the operation of the embodiment of the apparatus A shown in FIG. 14 is identical to that shown FIGS. 9–11.

Those skilled in the art will appreciate that there are advantages to the embodiment shown in FIGS. 9–11 to that shown in FIGS. 7–8. By using one or more motors which separate and bring together parallel plates, the collets 264' can be placed in a position where they can be easily pushed into a tubular 302. Then by reverse actuating the motor and allowing the locking mechanism 258 to push the collet assembly 264' outwardly, the apparatus A is locked to the tubular 302 and seal 298, which can be any type of seal, seals around the tube 294 to accept returns or to provide mud, depending on the direction of movement of the tubular 302. Thus, by the use of the motor 316, which brings together and separates the plates 314, the outward bias on the collet assembly 264' can be controlled by a power assist which greatly speeds up the connection and disconnection to each individual tubular 302. As in previous embodiments, the full bore of the tubular is maintained.

Those skilled in the art will appreciate that the invention encompasses the ready positioning and removal from being in the way of a fill-up and circulating tool while avoiding the need to disassemble it from the hoisting system of the rig, as had been required in the past. The design can operate fully automatically and from a convenient remote location. Other devices that can produce the movements required are contemplated within the scope of the invention. The advantage of being able to conduct drilling and tripping operations without dismantling the fill-up and circulating tool save time and space on the rig area. The compactness of the movements make the apparatus A readily useful in a variety of rigs, be they rotary or top drive. Newly constructed equipment can incorporate the support of the apparatus A into the bail 12 or 14. Alternatively, the traveling block can be the support point to allow raising and lowering while another assembly can rotate the device into position between the bails and out of the way outside the bails.

Those skilled in the art will also appreciate that although a hydraulic cylinder, pin and torque link are illustrated, movements can be accomplished by other methods. For example should the cylinder become inoperable, a hoisting line can be connected to the inlet pipe to move the inlet pipe up and down. In addition by disabling the pin and torque link a person in the derrick can move the fill-up and circulating tool from side to side, up and down to position the fill-up and circulating tool for connection with the tubular or out of the way.

The above description of the preferred embodiment is merely illustrative and those skilled in the art will appreciate that modification of the preferred design with regard to number, size, physical placement and movement of the parts can be undertaken without departing from the invention whose scope is fully determined by the claims below.

I claim:

1. An apparatus, mounted to a hoisting system in a rig having a longitudinal axis, defined by a pair of bails supporting an elevator, for selective positioning of a fill-up and circulating tool in a first position for contact with a tubular in the elevator and in a second out of the way position to allow drilling or tripping pipe, comprising:

a frame supported on the hoisting system;

a mechanism mounted to said frame and supporting the fill-up and circulating tool;

said mechanism capable of selectively translating the fill-up and circulating tool to move the fill-up and circulating tool into or out of alignment with a tubular in the elevator or to raise or lower the fill-up and circulating tool for selective contact with the tubular.

2. The apparatus of claim 1, wherein:

said mechanism can translate and raise or lower a the same time.

3. The apparatus of claim 2, further comprising:

a sleeve supported by said frame and operably connected to the fill-up and circulating tool in a manner that raising and lowering the fill-up and circulating tool will cause a moment in a plane transverse to the longitudinal axis of the hoisting system to act on the fill-up and circulating tool.

4. The apparatus of claim 3, wherein:

said sleeve and the fill-up and circulating tool are connected by a pin in a slot, said slot extending, at least in part, in a slant to induce said moment as said pin is raised or lowered.

5. The apparatus of claim 4, wherein:

said slanted portion of said slot has a length that corresponds to translation of the fill-up and circulating tool between a first position away from a tubular in the hoisting system and a second position where it is in alignment with a tubular in the hoisting system.

6. The apparatus of claim 5, wherein:

said slot further comprises a segment in substantial alignment with the longitudinal axis of the hoisting system such that movement of said pin in that portion of the slot raises or lowers the fill-up and circulating tool, without imparting a torque to it.

7. The apparatus of claim 6, wherein:

said sleeve is pivotally mounted to said frame about a first pivot;

said sleeve comprises an inlet pipe extending therethrough and connected to the fill-up and circulating tool, said inlet pipe operably connected to said sleeve by virtue of said pin and said slot;

said inlet pipe is pivotally mounted to said frame about a second pivot aligned with said first pivot.

8. The apparatus of claim 7, wherein:

said second pivot is disposed on a bracket slidably movable with respect to said frame in a direction generally aligned with the longitudinal axis of the hoisting system, said inlet pipe is connected to said second pivot by an inlet pipe link which allows tandem movement of said inlet pipe with said bracket in the longitudinal direction while allowing relative rotation between said inlet pipe link rotating about said second pivot and said inlet pipe.

9. The apparatus of claim 8, further comprising:

an actuation device to selectively raise or lower said bracket; and a torque link pivotally connected at opposed ends at said inlet pipe and at said bracket, said torque link responsive to actuation of said actuation device which in turn advances said pin in said slanted portion of said slot urges said inlet pipe link to rotate about said second pivot as said sleeve rotates about said first pivot.

10. The apparatus of claim 9, wherein:

said slot is disposed on said sleeve and said pin extending into said slot is mounted to said inlet pipe;

said torque link has an adjustable length for adjustment of the final position of the fill-up and circulating tool above a tubular.

11. The apparatus of claim 10, wherein:

said frame is mounted to only one of the bails.

12. The apparatus of claim 1, wherein:

said frame is mounted to only one of the bails.

13. The apparatus of claim 1, wherein:

said frame is rotationally locked to only one of the bails.

14. The apparatus of claim 1, wherein:

said frame is integrally made with only one of the bails.

15. A handling apparatus for a fill-up and circulating tool, comprising:

a pair of bails, each having a longitudinal axis, and supporting an elevator;

a frame mounted to one of said bails;

a mechanism connecting the fill-up and circulating tool to said frame;

said mechanism capable of selectively translating the fill-up and circulating tool to move the fill-up and circulating tool into or out of alignment with a tubular in the elevator as well as to raise or lower the fill-up and circulating tool for selective contact with the tubular.

16. The apparatus of claim 15, wherein:

said mechanism can translate and raise or lower at the same time.

17. The apparatus of claim 16, further comprising:

an inlet pipe connected to the fill-up and circulating tool and extending through a sleeve, said sleeve pivotally mounted to said frame on a first pivot and capable of pivoting on a plane substantially perpendicular to the longitudinal axis of said bail supporting said frame;

said sleeve operably connected to said inlet pipe by a pin and slot combination, said slot oriented in a manner to create a turning moment about said first pivot as said pin advances in a portion of said slot.

18. The apparatus of claim 17, further comprising:

a bracket movably mounted to said frame and further comprising a second pivot aligned with said first pivot;

an inlet pipe link extending from said second pivot to said inlet pipe in a manner where raising or lowering said bracket with said inlet pipe link raises or lowers said inlet pipe while allowing said inlet pipe to rotate with respect to said inlet pipe link.

19. The apparatus of claim 18, further comprising:

a torque link pivotally mounted on both ends and extending from said bracket to said inlet pipe;

said slot disposed on said sleeve and further comprising a first segment transverse to the longitudinal axis of said bail and a second segment substantially parallel to the longitudinal axis of said bail;

said pin in said slot mounted to said inlet pipe such that movement of said pin in said first segment of said slot as a result of movement of said bracket with respect to said frame, imparts rotation to said inlet pipe about said first and second pivots due to said toque link, to selectively position the fill-up and circulation tool in alignment with a tubular in the elevator or out from between said bails to allow operations such as drilling or tripping to take place.

20. The apparatus of claim 19, wherein:

said bracket is moved in opposed directions by a hydraulic piston;

said torque link has an adjustable length for proper end positioning of the fill-up and circulating tool over a tubular in the elevator.

* * * * *